US005639521A

United States Patent [19]

Fraus et al.

[11] Patent Number: 5,639,521

[45] Date of Patent: Jun. 17, 1997

[54] ORNAMENTAL CHRISTMAS DISPLAY

[76] Inventors: Joan K. Fraus, 1898 Henrietta, Birmingham, Mich. 48009; Pamela M. Santo Smith, 29606 Moran, Farmington Hills, Mich. 48336

[21] Appl. No.: 592,526

[22] Filed: Jan. 26, 1996

[51] Int. Cl.[6] ..... A47G 33/06

[52] U.S. Cl. ..... 428/8; 362/123; 428/10; 428/18

[58] Field of Search ..... 428/7, 8, 18, 19, 428/20, 10; 362/123

[56] References Cited

U.S. PATENT DOCUMENTS

| | | | |
|---|---|---|---|
| 2,864,192 | 12/1958 | Shoalts | 428/18 X |
| 3,096,943 | 7/1963 | Forrer | 428/19 X |
| 3,677,867 | 7/1972 | Westlund | 428/20 X |
| 3,857,748 | 12/1974 | Thomann | 428/8 |
| 4,543,278 | 9/1985 | Ackerman | 428/18 |
| 4,612,218 | 9/1986 | Enterline | 428/18 X |
| 4,937,107 | 6/1990 | Mirisch, Sr. | 428/18 X |
| 4,968,541 | 11/1990 | McCrory | 428/20 X |
| 5,338,585 | 8/1994 | Fraus et al. | 428/18 |

*Primary Examiner*—Henry F. Epstein
*Attorney, Agent, or Firm*—John R. Benefiel

[57] ABSTRACT

A seasonal display in a characteristic shape such as a Christmas tree or wreath formed by a pliable backing sheet allowing roll up storage densely covered with artificial evergreen garlands. A formable wire is disposed in a hem of the backing sheet to form a frame to stabilize its shape, with a depth effect enabled by curving the bottom edge of the Christmas tree. A plurality of the displays can be detachably connected together to form a three-dimensional display viewable from all sides.

10 Claims, 2 Drawing Sheets

ORNAMENTAL CHRISTMAS DISPLAY

BACKGROUND OF THE INVENTION

This invention concerns displays, and more particularly a seasonal display which can be rolled up for storage.

The present inventors have heretofore been granted U.S. Pat. No. 5,338,585 issued on Aug. 16, 1994 for an "Ornamental Christmas Display" relating to such displays. That patent describes a display consisting of a pliant backing sheet formed with a pattern of openings into which are interwoven garland segments, which are densely arrayed to completely cover the backing sheet and create an evergreen appearance. The garlands preferably extend generally parallel to each other and across the width of the backing sheet to allow the backing sheet and garlands to be rolled up together without the need to first remove the garlands.

That patent also describes a rod mounted to the bottom of the backing sheet which prevents the backing sheet from draping and holds the sheet down and in a desired outline shape, i.e., a triangular Christmas tree.

The present inventors have discovered an improved construction for maintaining the perimeter shape, while still readily allowing roll up of the display. Further, for a Christmas tree display in particular, the improved shaping construction allows for giving the display to have a three-dimensional or depth effect, again while allowing the display to readily be rolled up without requiring removal of the garlands or ornaments.

The present inventors have also devised an improved display construction according to the prior patent specifically applied to an ornamental wreath.

SUMMARY OF THE INVENTION

The present invention comprises a pliable backing sheet cut to a shape defining the outline of a seasonal display. Garland strands are attached as by being woven through a hole pattern in the backing, extending in a side-to-side direction and forming a dense covering.

The perimeter of the backing sheet has an attached hem within which is disposed a bendable wire perimeter stiffening structure which holds its shape when formed.

For a Christmas tree display, the formable wire perimeter structure allows the bottom side of a triangular shape creating the tree shape to be carved out, giving a three-dimensional effect by curving the display out from the other two sides of the display. The bendable wire frame allows the display to be rolled up.

Two or more of the individual displays can also be clipped together to form a three-dimensional display viewable from all sides, which can be disassembled and the individual displays rolled up for storage.

A wreath version likewise uses a formable wire defining the perimeter of an annular backing sheet to hold the wreath shape while allowing roll up of the wreath. In addition, an optional pair of horizontal rods on either side of the center hole have their ends received in pockets in the perimeter hem to further stiffen the shape of the wreath when displayed.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 8:
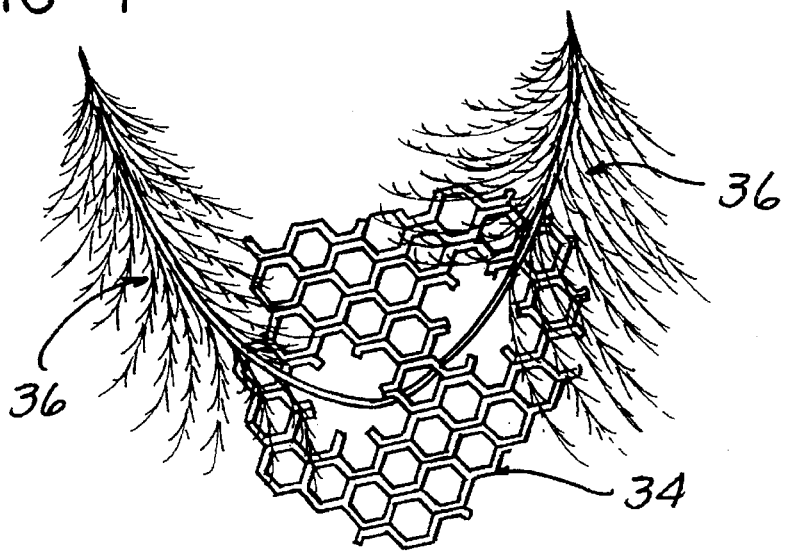
FIG. 8 is an enlarged perspective view of fragmentary portions of the backing sheet and a garland strand interwoven therein.

Referring to FIGS. 1–5, the ornamental display shown in these Figures comprises a seasonable display such as Christmas tree display 10 adapted to be supported as by being hung on a wall surface 12. The perimeter shape of the display 10 is defined by a triangular back sheet 14 of a pliable material having garland segments 16 of artificial evergreen plant material attached thereto, as by interweaving the garland segments through openings in the backing layer 14 (FIG. 8). The backing sheet 14 can be comprised of a durable nylon or mesh netting material, with enlargements made at intervals through which the garland segments 16 can be drawn to be interwoven in the netting.

The garland segments 16 are preferably interwoven along paths parallel to the bottom side 18 of the backing sheet 14 are closely spaced so as to densely cover the surface of one side of the backing sheet 14.

Figure 5:
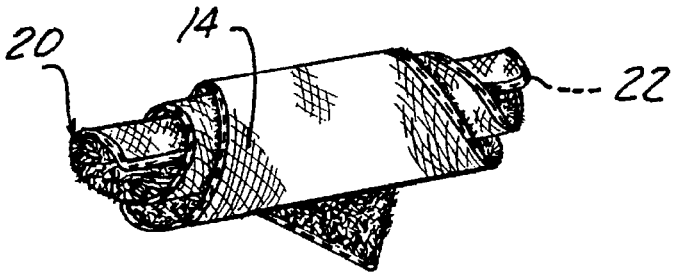
FIG. 5 is a perspective view of the display of FIGS. 1 and 2, flattened and rolled up for storage.

According to the present invention, the backing sheet 14 has a hem 20 sewn or otherwise attached along the perimeter which contains a medium diameter, i.e., 16 gauge readily formable wire 22, which stiffens the perimeter of the backing sheet 14 to hold the tree shape, yet still allows the display to be rolled up as shown in FIG. 5. The roll is started at the bottom side 18 to cause the parallel extending garland segments to extend lengthwise to the roll formed, enabling a more compact and stable roll to be formed.

Figure 1:
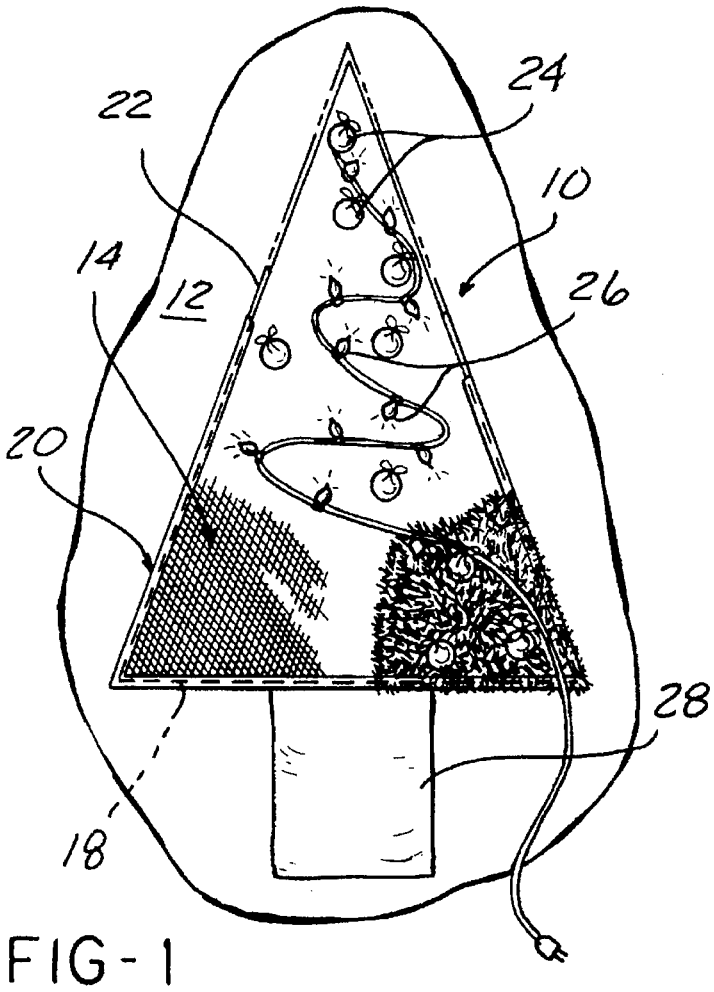
FIG. 1 is a front elevational view of a Christmas tree ornamental display according to the present invention, portions partially broken away.
Figure 3:
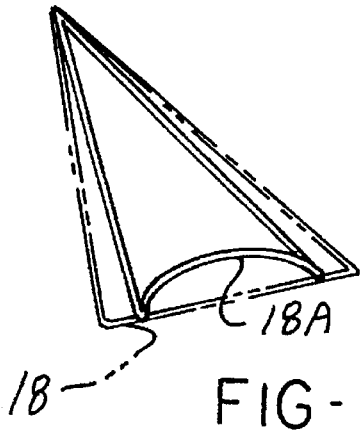
FIG. 3 is a diagram of the reforming of the display perimeter from a flat plane into a curved shape.
Figure 4:
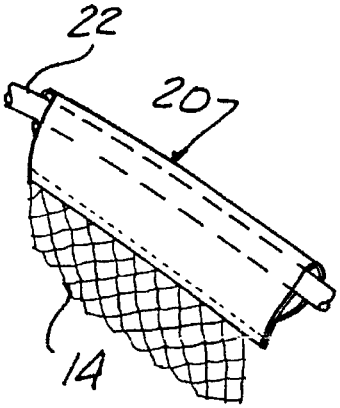
FIG. 4 is an enlarged fragmentary view of a small section of the display shown in FIGS. 1 and 2.
Figure 2:
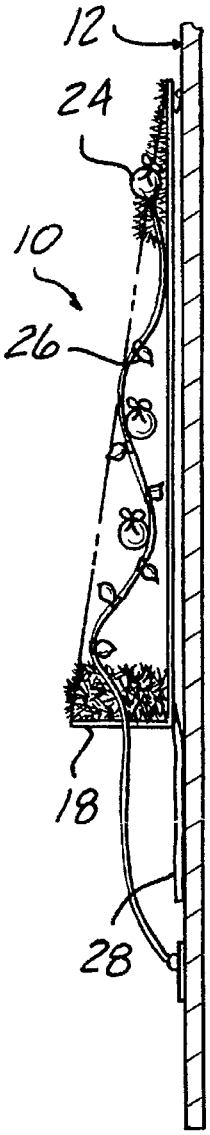
FIG. 2 is a side elevational view of the display shown in FIG. 1.

The backing sheet 14 can be shaped as indicated in FIG. 3, by curving the wire 22 in the bottom side 18A. This gives a depth effect when hung on a wall, as the "tree" protrudes out from the wall surface 12 taking a semi-conical shape, as seen in FIG. 2.

The wire 22 can be restraightened to flatten the backing sheet 14, preparatory to rolling up the tree. The formable wire 22 also tends to hold the display 10 in its rolled up condition.

Suitable ornaments 24 and lights 26 are also preferably included, which can remain attached when the backing sheet 14 and garlands are rolled up, serving to protect the same from breakage.

A bottom skirt 28, comprised of a fabric such as felt resembles a base.

Figure 3A:
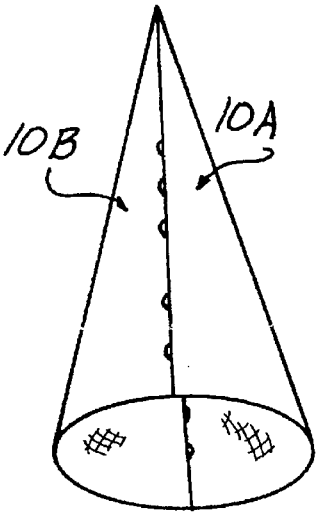
FIG. 3A is a diagram of an assembly of a plurality of Christmas tree displays to form a three-dimensional display which can be suspended.

FIG. 3A shows that a plurality of the displays 10A, 10B, can be clipped together along contiguous sides to be detachably connected together, and shaped to form a three-dimensional display viewable from all sides. Such a display can be suspended from an overhead supporting structure, or could be self-supporting on a horizontal surface. Upon disassembly and flattening of each display 10A, 10B, these may be rolled up individually for storage.

Figure 6:
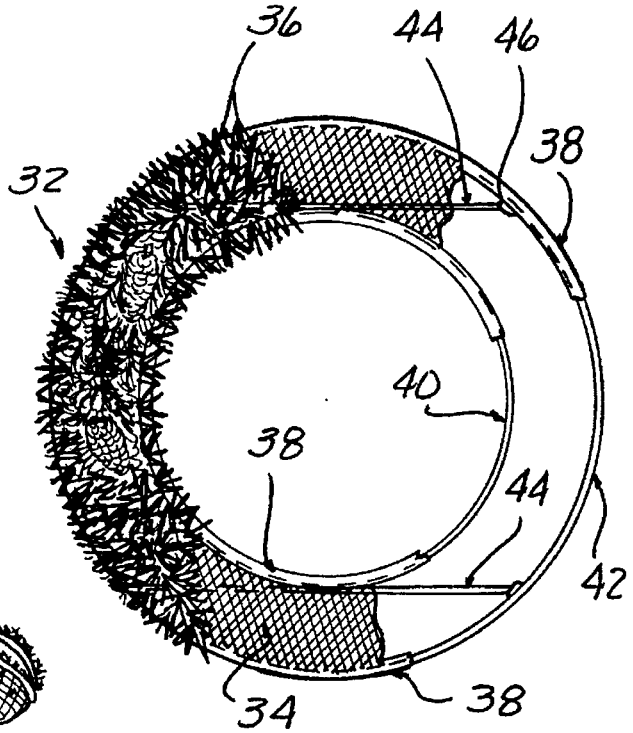
FIG. 6 is a front view of a wreath version of a display according to the invention, with portions partially broken away.
Figure 7:
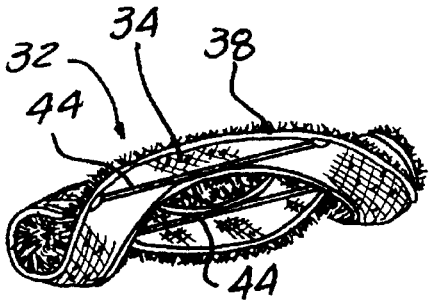
FIG. 7 is a perspective view of the wreath display shown in FIG. 6.

FIGS. 6 and 7 show a wreath form ornamental display 32 in which an annular backing sheet 34 is provided having garland segments 36 interwoven to produce a dense covering of one side.

The backing sheet 34 is provided with a hem 38 on the inner and outer diameters, each receiving a formable wire hoop 40, 42 to enable the backing sheet 34 to hold its shape, while allowing the wreath 32 to be rolled up as shown in FIG. 7.

A pair of parallel, stiff rods or sticks 44 are provided, extending chordally across the top and bottom of the backing sheet 34, anchored at each end at the perimeter by suitably located pockets 46 in the hem 38. These rods 44 reinforce the annular shape of the wreath 32 in its rolled, flattened shape.

While a Christmas tree and wreath have been shown, other seasonal themes or other shapes such as a snowman, bell, etc. may be used for the display.

Also displays in the form of sheets or strips can be used as hangings or can wrap around poles, etc, the wire bent to conform to the display as needed.

We claim:

1. An ornamental seasonal display comprising:

a backing sheet of a pliable material;

an array of covering material comprising artificial evergreen garland segments attached to one side of said backing sheet;

said array of covering material densely covering one side of said backing sheet;

said backing sheet and covering material being able to be rolled up together without detaching said covering material;

said backing sheet having a hem extending around a perimeter of said backing sheet;

a formable elongate element contained within said hem to stiffen the perimeter of said backing sheet, said formable element able to be manually bent, but able to retain its shape after bending so as to hold said backing sheet in a manually formed shape enabling said backing sheet to be manually shaped and be retained in the formed shape after being unrolled.

2. The ornamental display according to claim 1 wherein said backing sheet is in a triangular shape to resemble a Christmas tree, said hem and formable elongate element extending along a bottom edge of said triangular shape to be formable into a curved contour after unrolling of said backing sheet to form a three-dimensional effect.

3. The ornamental display according to claim 2 further including Christmas ornaments attached to said one side of said display.

4. The ornamental display according to claim 3 further including a string of electric lights mounted on said one side of said display.

5. The ornamental display according to claim 1 wherein said backing sheet comprises a mesh material.

6. The ornamental display according to claim 1 wherein said backing sheet is in an annular shape, said covering material comprising artificial evergreen garland segments creating a wreath appearance, said hem extending around both the inner and outer diameters thereof, with an elongate formable element in each hem so as to hold said annular shape after unrolling.

7. The ornamental display according to claim 6 further including a pair of stiff elongate elements extending across said backing sheet on the other side from said one side, each element having opposite ends secured to said hem attached to the outer diameter thereof.

8. The ornamental display according to claim 1 wherein said formable element comprises a wire.

9. The ornamental display according to claim 1 wherein a plurality of said displays are detachably connected together to form a three-dimensional display viewable from all sides.

10. The ornamental display according to claim 9 wherein said plurality of said displays each comprise a triangular Christmas tree shape clipped together along contiguous sides and can be formed into a generally conical shape.

* * * * *